US008011036B2

(12) United States Patent
Tuckey

(10) Patent No.: US 8,011,036 B2
(45) Date of Patent: Sep. 6, 2011

(54) PLAY YARD WITH HEIGHT ADJUSTABLE CHANGING TABLE

(75) Inventor: Peter R. Tuckey, Morgantown, PA (US)

(73) Assignee: Wonderland Nurserygoods Co., Ltd, Taipei (TW)

( * ) Notice: Subject to any disclaimer, the term of this patent is extended or adjusted under 35 U.S.C. 154(b) by 0 days.

(21) Appl. No.: 12/254,948

(22) Filed: Oct. 21, 2008

(65) Prior Publication Data

US 2009/0113624 A1 May 7, 2009

Related U.S. Application Data

(60) Provisional application No. 61/001,428, filed on Nov. 1, 2007.

(51) Int. Cl.
*A47C 7/00* (2006.01)

(52) U.S. Cl. ..... 5/93.1; 5/98.1

(58) Field of Classification Search ..... 5/655, 93.1, 5/98.1, 99.1, 507.1, 503.1, 658
See application file for complete search history.

(56) References Cited

U.S. PATENT DOCUMENTS

| | | | | |
|---|---|---|---|---|
| 2,650,784 | A * | 9/1953 | Thayer et al. | 248/95 |
| 5,274,863 | A | 1/1994 | Fountain | 5/120 |
| 5,349,709 | A | 9/1994 | Cheng | 5/93.1 |
| 5,553,336 | A | 9/1996 | Mariol | 5/93.1 |
| 5,957,436 | A * | 9/1999 | Ristau | 256/25 |
| 6,253,399 | B1 * | 7/2001 | Wagner | 5/507.1 |
| 6,421,857 | B2 * | 7/2002 | Whatman et al. | 5/663 |
| 6,948,197 | B1 * | 9/2005 | Chen | 5/93.1 |
| 7,203,981 | B1 | 4/2007 | Cowgill | 5/109 |
| 7,234,182 | B2 * | 6/2007 | Miller et al. | 5/662 |
| 7,581,269 | B2 * | 9/2009 | Chen et al. | 5/655 |
| 2002/0166169 | A1 * | 11/2002 | Longenecker et al. | 5/93.1 |
| 2005/0150053 | A1 * | 7/2005 | Hartenstine | 5/655 |
| 2006/0080776 | A1 * | 4/2006 | Clapper et al. | 5/93.1 |
| 2006/0085917 | A1 * | 4/2006 | Miller | 5/662 |
| 2006/0130237 | A1 * | 6/2006 | Clapper et al. | 5/655 |
| 2006/0225204 | A1 | 10/2006 | Bretschger | 5/99.1 |
| 2006/0225205 | A1 | 10/2006 | Troutman | 5/93.1 |
| 2006/0253980 | A1 * | 11/2006 | Paesang et al. | 5/99.1 |
| 2008/0034506 | A1 * | 2/2008 | Chen et al. | 5/655 |
| 2008/0127412 | A1 * | 6/2008 | Pleiman et al. | 5/99.1 |
| 2009/0049606 | A1 * | 2/2009 | Zhao et al. | 5/97 |
| 2009/0113622 | A1 * | 5/2009 | Hartenstine | 5/2.1 |

* cited by examiner

*Primary Examiner* — Michael Trettel
*Assistant Examiner* — William Kelleher
(74) *Attorney, Agent, or Firm* — Miller Law Group, PLLC

(57) ABSTRACT

A changing table is mounted on the frame of a play yard to be vertically adjustable in operative height and pivotally movable between operative and inoperative positions. The frame of the changing table is provided with a downwardly extending guard member that extends across the opening between the frame of the changing table and the frame of the play yard to prevent a child's head from being trapped in the opening. The use of the guard member enables the changing table to be moved through a greater vertical range of operative positions without violating ASTM standards regarding the passage of probes through frame openings. The height adjustment mechanism is mounted within the vertical frame member of the play yard and the vertical mounting member of the changing table to allow the changing table to be raised and lowered with respect to the upper frame members of the play yard.

18 Claims, 11 Drawing Sheets

PLAY YARD WITH HEIGHT ADJUSTABLE CHANGING TABLE

CROSS-REFERENCE TO RELATED APPLICATIONS

This application claims priority on U.S. Provisional Patent Application Ser. No. 61/001,428, filed on Nov. 1, 2007, and entitled "Height Adjustable Changing Table for Play Yard", the contents of which are incorporated herein by reference.

FIELD OF THE INVENTION

The present invention relates generally to a child's play yard enclosure and, more particularly, to a play yard having a changing table mounted on one end thereof and being movable vertically relative to the play yard frame to vary the vertical height thereof.

BACKGROUND OF THE INVENTION

Play yards are used to contain and provide a safe environment for a child for sleeping or playing. Typically, play yards are collapsible so they can be stored or transported easily. Currently, play yards are manufactured with a frame that consists of a combination of assembled metal and plastic components with a fabric body that wraps around the frame to provide an enclosure to retain the child within the play yard. Play yards can be equipped with a bassinet assembly that can be supported by the play yard frame to establish an enclosed sleep area at a higher level than the bottom floor surface of the play yard to provide an easy access to the child without requiring the caregiver to bend to access the floor of the play yard.

Play yards are often provided with an elevated changing table on which an infant can be placed to position the infant at an elevated position for the convenience of the caregiver changing the infant's clothes. Changing tables include a frame that is supported on the frame of the play yard. Typically, the height of commercially available changing tables is fixed relative to the frame of the play yard so that the movement of the changing table frame will not create a head entrapment situation as defined by ASTM F 406-08 5-16. This is an ASTM standard that requires openings between frame members of structures holding children to be sufficiently large as to allow the passage of a large probe sized to replicate the $97^{th}$ percentile dimension of a 3 year olds back of head to tip of chin dimension, or to be smaller than a small probe sized to represent the dimensions of a $5^{th}$ percentile, six month old child's head.

Complying with such an ASTM standard limits the movement of the changing table as the frame of the changing table and the frame of the play yard must remain, at all positions of height adjustment to either permit passage of the ASTM large probe or prevent passage of the ASTM small probe. Accordingly, conventional changing tables will have the range of movement such that the frame of the changing table will not be far enough above the frame of the play yard to allow the ASTM small probe to pass between the two frame members. Alternatively, the changing table will remain sufficiently far above the frame of the play yard that the ASTM large probe will always be able to pass between the two frame members. In the first instance, the range of movement is limited to only a few inches. In the second instance, the changing table will be positioned too high to provide a convenient and efficient usage.

Accordingly, it would be desirable to provide a play yard/changing table structure that will allow a larger range of vertical movement that will allow the frame of the changing table to be raised above the frame of the play yard to height positions that with present designs create head entrapment violations as defined in the ASTM specifications.

A bassinet is disclosed in U.S. Pat. No. 5,553,336, issued to John Mariol on Sep. 10, 1996, as being mountable onto the frame of a play yard with legs of the bassinet being received within the legs of the play yard. The Mariol bassinet is sufficiently large as to cover the entire upper portion of the play yard such that the bassinet and the play yard would not be simultaneously usable. Furthermore, the Mariol bassinet is not height adjustable with respect to the frame of the play yard.

U.S. Patent Publication No. 2002/0166169 of Michael Longenecker, et al published on Nov. 14, 2002, discloses a changing table for a play yard in which the changing table is pivotable about a transversely extending horizontal axis to be movable between an operating position and a storage position. Since the Longenecker changing table is not height adjustable, the base frame of the changing table and the play yard are fixed relative to one another. Similarly, a pivotable changing table mounted on the frame of a play yard is disclosed in U. S. Patent Publication No. 2006/0130237 of Johsua Clapper, et al published on Jun. 23, 2006. Like the Longenecker changing table, the Clapper changing table is fixed relative to the frame of the play yard and is pivotable about a transversely extending, horizontal pivot axis to permit the changing table to move between an operative position and a storage position.

A height adjustable changing table mounted on the frame of a play yard is shown in U.S. Patent Publication No. 2005/0150053 of Curtis M. Hartenstine published on Jul. 14, 2005, in which the changing table is movable through a range of positions through a rack and pinion mechanism with the lowermost position of the changing table being well above the frame of the play yard. The changing table is also pivotable about a transversely extending, horizontal pivot axis to move between an operative orientation and a storage orientation.

It would be desirable to provide a changing table structure that would be mountable on the frame of a play yard and be movable between positions where the frame of the changing table can be located above the frame of the play yard a distance greater than the dimension of the ASTM small probe.

SUMMARY OF THE INVENTION

It is an object of this invention to provide a changing table structure for mounting on the frame of a play yard to provide an effective and conveniently usable station to place an infant child in order to change the infant's clothes.

It is another object of this invention to provide a changing table that can be mounted on the frame of a play yard to be vertically adjustable through a range of operative heights relative to the play yard frame.

It is a feature of this invention that the frame of the changing table is provided with a vertically extending guard member to block any head entrapment openings between the frame of the changing table and the frame of the play yard.

It is another feature of this invention that the guard allows the frame of the changing table to be moved to a vertical height without violating ASTM standards for head entrapment.

It is an advantage of this invention that the guard blocks the opening between the changing table frame and the play yard frame to prevent a child's head from getting trapped between the frame of the changing table and the frame of the play yard.

It is another advantage of this invention that the guard will pass below the frame of the play yard when the changing table height is lowered.

It is yet another feature of this invention that the guard affixed to the changing table frame allows the range of vertical movement of the changing table to be increased.

It is another object of this invention to provide a changing table for mounting on a play yard frame which is both height adjustable and pivotable to move between operative and inoperative positions.

It is still another object of this invention to provide a height adjustment mechanism for a play yard mounted changing table that is housed within the frame of the play yard.

It is a further object of this invention to provide a changing table structure for mounting on a play yard frame that is durable in construction, inexpensive of manufacture, carefree of maintenance, facile in assemblage, and simple and effective in use.

These and other objects, features and advantages are accomplished according to the instant invention by providing a changing table that is mounted on the frame of a play yard to be vertically adjustable in operative height and pivotally movable between operative and inoperative positions. The frame of the changing table is provided with a downwardly extending guard member that extends across the opening between the frame of the changing table and the frame of the play yard to prevent a child's head from being trapped in the opening. The use of the guard member enables the changing table to be moved through a greater vertical range of operative positions without violating ASTM standards regarding the passage of probes through frame openings. The height adjustment mechanism is mounted within the vertical frame member of the play yard and the vertical mounting member of the changing table to allow the changing table to be raised and lowered with respect to the upper horizontal frame members of the play yard.

BRIEF DESCRIPTION OF THE DRAWINGS

The advantages of this invention will be apparent upon consideration of the following detailed disclosure of the invention, especially when taken in conjunction with the accompanying drawings wherein.

DETAILED DESCRIPTION OF THE PREFERRED EMBODIMENT

Figure 1:
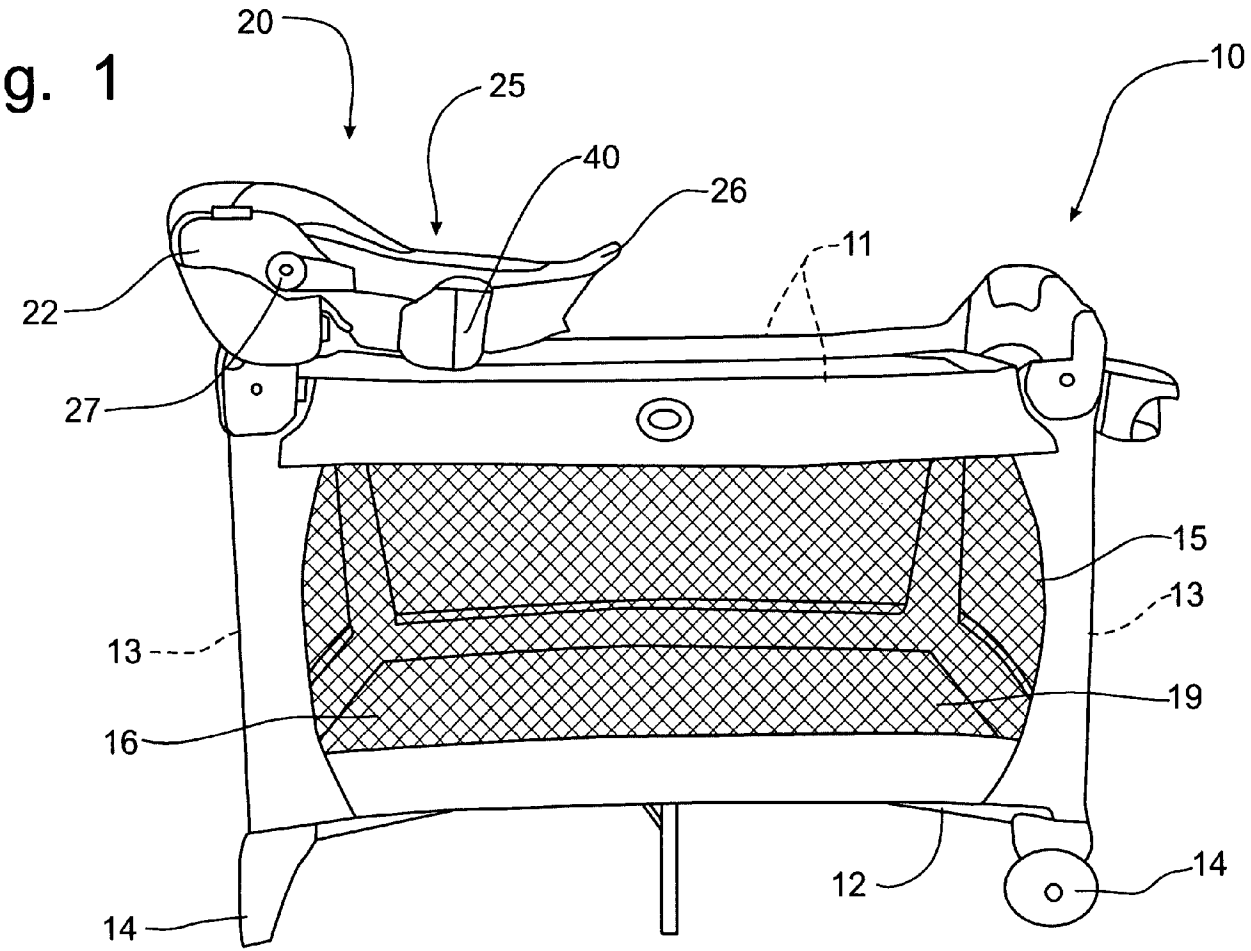
FIG. 1 is a side elevational view of a play yard having a changing table incorporating the principles of the instant invention mounted thereon.
Figure 2:
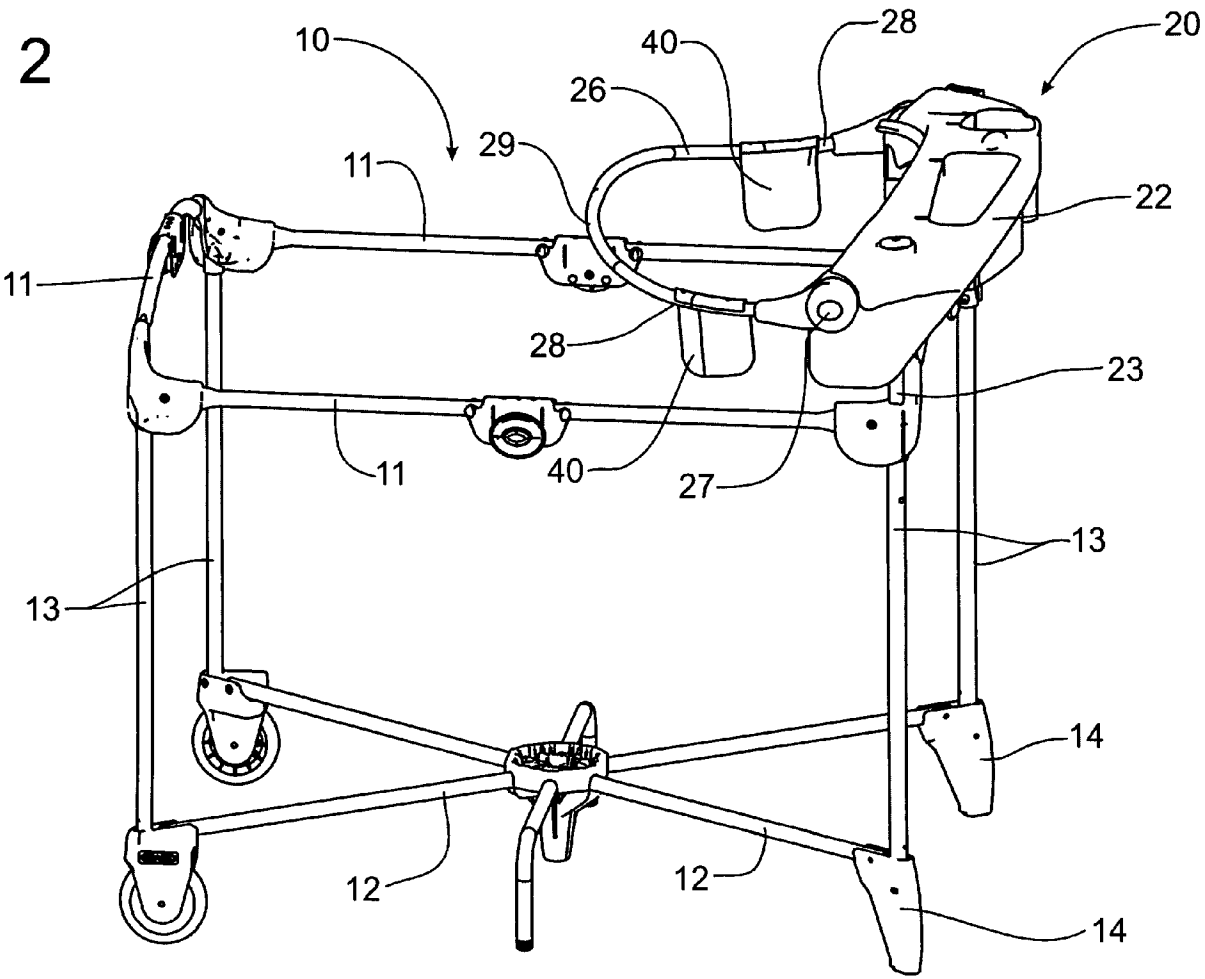
FIG. 2 is a perspective view of the frame of the play yard shown in FIG. 1 having the changing table mounted thereon and placed in a raised operative position.

Referring now to the drawings, a child play yard incorporating the principles of the instant invention can best be seen. For purposes of clarity, the play yard and the changing table are shown in FIGS. 2-10 with the soft goods removed to show the frame members of the respective components. As best seen in FIG. 1, the play yard 10 incorporates a frame structure that is covered by the fabric body 15. The frame structure includes upper frame members 11 defining a generally rectangular shape around the top of the play yard 10 establishing an upper boundary thereof, lower frame members 12 positioned below the upper frame members 11 and providing a generally rectangular support for the floor member 19 of the play yard 10, and vertical frame members 13 interconnecting the upper and lower frame members 11, 12 and defining the corners of the play yard 10. The vertical frame members 13 terminate in respective foot members 14 that are attached to the vertical frame members 13 to engage the floor support surface on which the play yard is disposed.

While the preferred embodiment of the play yard 10 defines the upper boundary of the play yard by the upper frame member 11 supported by vertically extending frame members 13 which extend upwardly from the lower frame members 12, one skilled in the art will recognize that the frame configuration of the play yard 10 could be substantially different. For example, the upper boundary of the play yard 10 could be formed from the soft goods, i.e. fabric that is stretched taut between vertically extending frame members or posts. The frame configuration of the play yard 10 might not have vertical frame members or posts that form the corners of the play yard 10. The vertical frame members could be oriented diagonally along the sides of the play yard 10 with the soft goods defining the vertical corners of the play yard 10 extending between upper and lower frame members. One skilled in the art will recognize that in all play yard configurations, the play yard 10 will have an upper boundary, a bottom and sides extending between the upper boundary and the bottom supported by a frame structure.

The fabric body 15 forms an enclosure around the periphery of the play yard 10. The fabric body 15 is preferably formed with an upper tunnel through which the upper frame members 11 are placed to support the upper portion of the fabric body. The fabric body 15 is then drawn taut forming vertical corners around the vertical frame members 13. The fabric body 15 is also drawn taut over the lower frame members 12 and secured, as will be described in greater detail below. The fabric body 15 preferably includes generally vertical mesh portions 16 to facilitate viewing a child positioned on the play yard floor 19.

Figure 3:
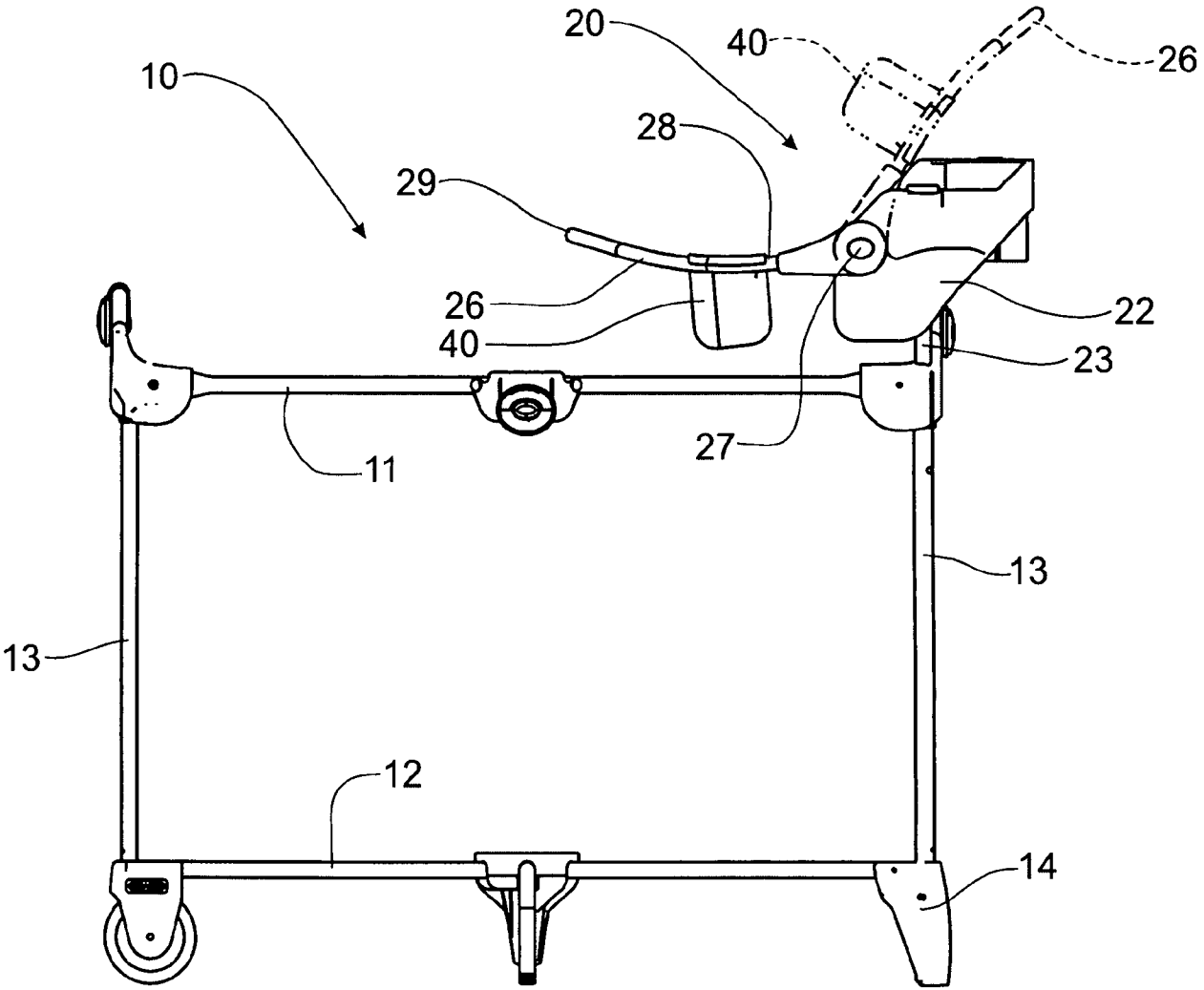
FIG. 3 is a side elevational view of the play yard and changing table frames as depicted in FIG. 2, the pivoted inoperative position of the changing table frame being shown in phantom.
Figure 4:
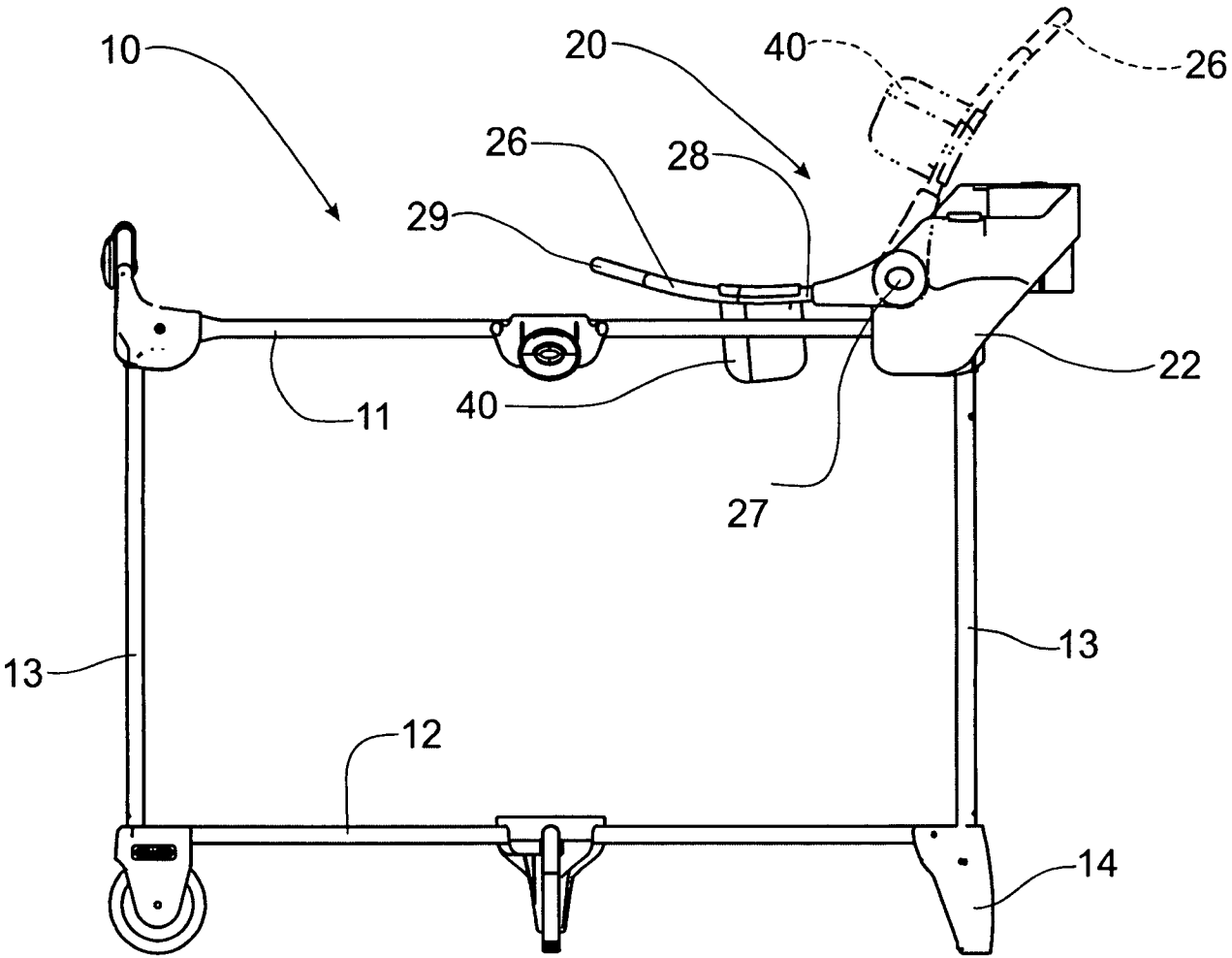
FIG. 4 is a side elevational view of the play yard and changing table frames similar to that of FIG. 3, but showing the changing table in a lowered operative position, the pivoted inoperative position of the changing table frame being shown in phantom.
Figure 5:
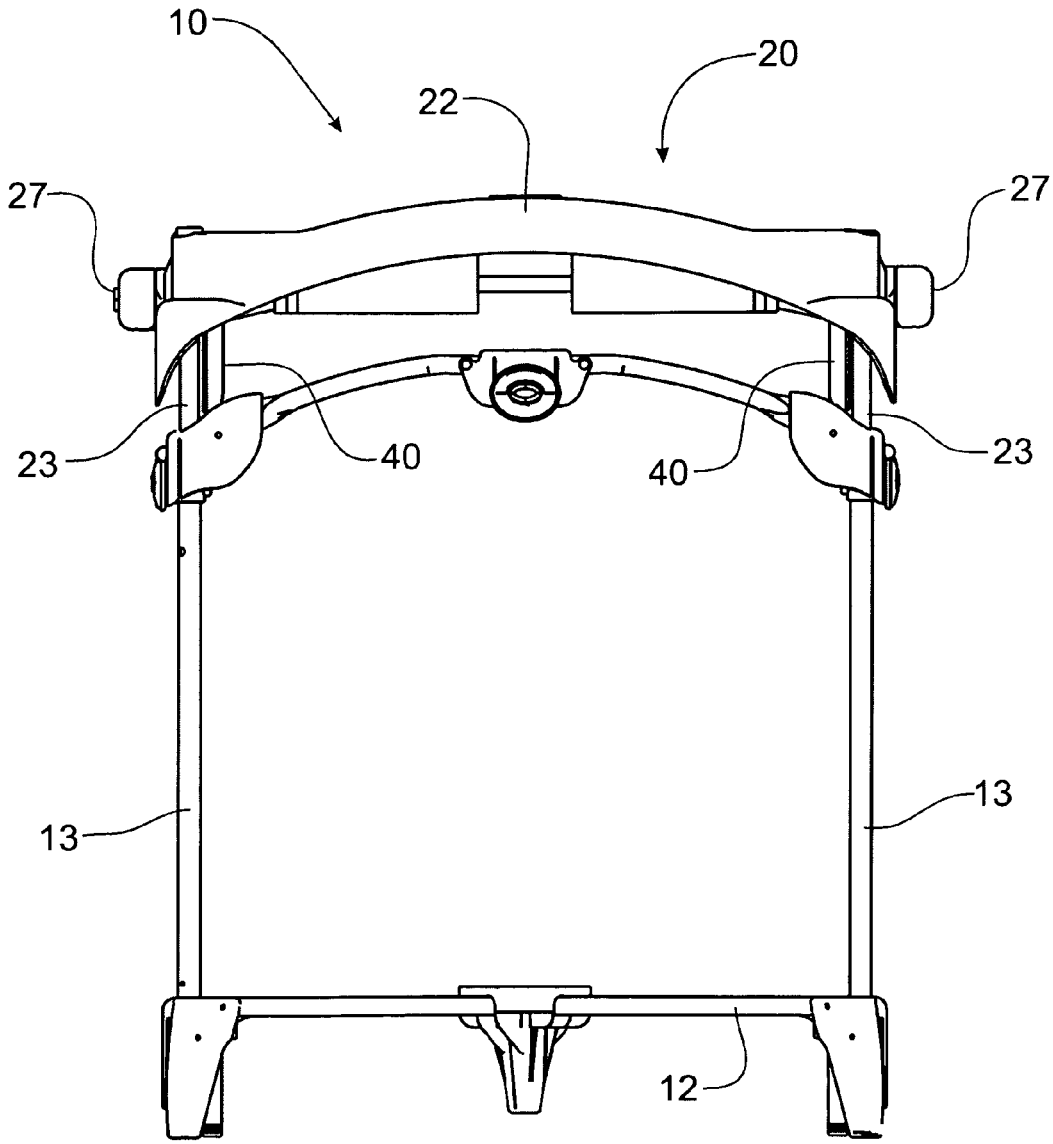
FIG. 5 is an end elevational view of the play yard and changing table frames as depicted in FIG. 3.

Referring now to FIGS. 1-13, a changing table 20 can be mounted on the top of the play yard 10 to provide a support surface for placing an infant at the convenient access of the caregiver so that the caregiver can easily change the infant's clothes. The changing table has a base member 22 having vertically extending mounting members 23 that are telescopically received within the corresponding vertical frame members 13 of the play yard 10 to support the changing table 20 on top of the play yard 10. The base member 22 supports a table 25 having a table frame member 26 pivotally connected to the base member 22 about a horizontally extending pivot axis 27. As depicted in FIGS. 3 and 4 and best seen in FIG. 9, the table 25 is pivotally movable between an inoperative position shown in phantom, and an operative position extending generally horizontally from the base member 22.

Figure 13:
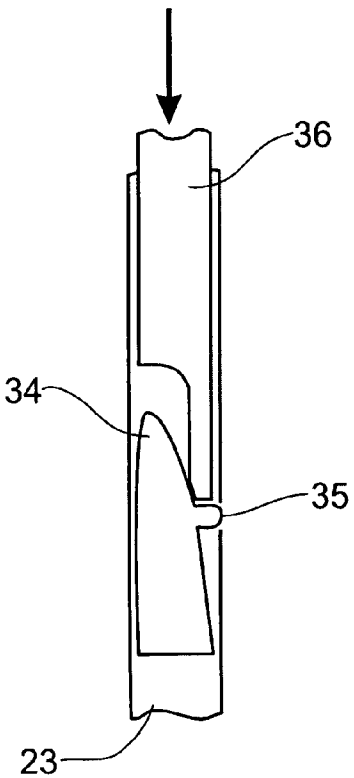
FIG. 13 is an enlarged detail view of the engagement of the actuator to move the lock tab to a release position and permit a vertical movement of the changing table relative to the play yard frame.
Figure 12:
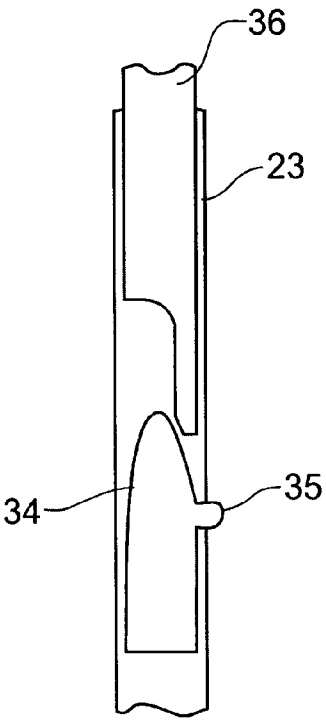
FIG. 12 is an enlarged detail view of the actuator for the lock tab of the changing table height adjustment mechanism, the lock tab being in a locked position.
Figure 11:
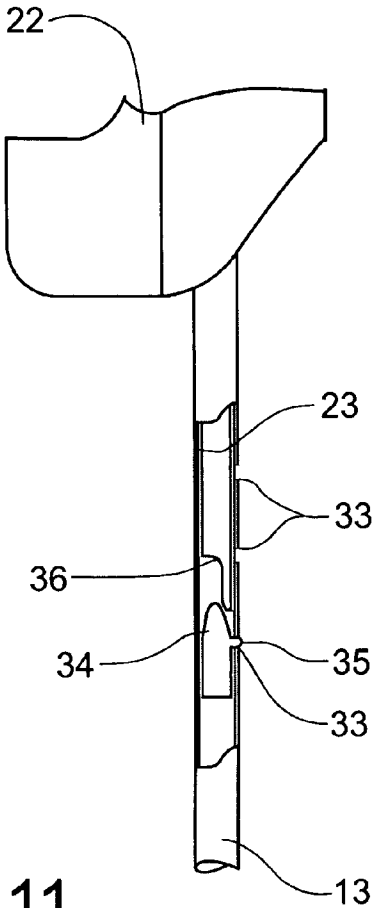
FIG. 11 is a schematic partial elevational view of the vertical play yard frame member supporting the changing table frame with portions of the frame member broken away to shown the height adjustment mechanism for the changing table housed within the play yard frame.

The changing table 20 is supported to be positionally adjustable in a vertical direction to locate the table 25 along a range of vertical heights from the raised operative position shown in FIG. 3 to the lower operative position shown in FIG. 4, with the number of intermediate positions being a matter of choice. As can be seen in FIGS. 11-13, the vertical mounting members 23 are formed with a locking apparatus 30 that engages openings 33 formed in the vertical frame members 13 to lock the vertical mounting members 23 into a selected position and secure the vertical height of the changing table 20. The locking mechanism 30 can be formed with a locking button 35 that is configured to project through the selected opening 33 in the vertical frame member 13, the locking button 35 being formed as part of a leaf spring 34 positioned within the vertical mounting member 23.

An actuator 36 is operated from a spring-biased push button (not shown) accessible at a convenient location at the top of the base member 22 to depress the actuator 36 into engagement with the spring 34. As seen in a comparison between FIGS. 11 and 12, the actuator 36 moves along the sloped surface of the spring 34 to cam the spring 34 into the interior of the vertical mounting member 23 and retract the locking button 35 into the vertical mounting member 23 out of engagement with the vertical frame member 13. The changing table 20 can then be relocated at a desired height and the actuator 36 released to allow the spring 34 to urge the locking button 35 toward and through an aligned opening 33 corresponding to the selected height of the changing table 20.

The range of vertical movement of the changing table 20 affects a corresponding movement of the frame member 26 relative to the upper frame member 11 of the play yard. ASTM standards require that two frame members for a structure on which children are to be placed be spaced such that the ASTM large probe is capable of passing between the two frame members or that the ASTM small probe cannot be passed between the two frame members. With the vertical movement of the changing table frame 26 relative to the play yard upper frame member 11 resulting in a variable spacing distance, depending on the height position selected for the table 25, care must be taken to prevent the spacing between the changing table frame 26 and the play yard upper frame member 11 from being configured to allow the passage of the small probe therebetween. As a result, the vertical height of the table 25 is conventionally limited to a position so that the frame 26 is not above a maximum spacing from the upper frame member 11, allowing the passage of the ASTM small probe.

To allow an extended range of movement of the changing table 20 and provide a greater measure of convenience and comfort for the caregiver, the frame 26 of the changing table 20 can be formed with a guard member 40 that is affixed to the frame 26 and depends downwardly therefrom. One guard member 40 is positioned on each side of the table 25 to block the opening between the frame 26 and the lower frame member 11 of the play yard. 10. As can be seen in FIGS. 3, 5, 7 and 10, the guard member 40 prevents the passage of the ASTM small probe 42 between the changing table frame 26 and the upper frame member 11 of the play yard, and consequently, prevents the insertion of a child's head between the changing table frame 26 and the upper frame member 11, when the changing table 20 is in the uppermost raised operative position, as is depicted in FIGS. 3, 5, 7 and 10.

The changing table frame 26 includes a longitudinally extending portion 28 that extends from the pivot 27 and runs generally parallel to the upper frame members 11 to provide some depth for the table 25 from the base member 22. The transversely opposed longitudinally extending members 28 are joined by a curved transverse portion 29 to define the table frame member 26. The guard members 40 are preferably affixed to the longitudinally extending portions 28 where the transverse portion 29 joins the longitudinal portions 28. The guard members 40 then extend along the longitudinal portion 28 toward the pivot 27 a sufficient distance as to block the gap between the table frame 26 and the upper frame member 11 and leave no opening between the guard member 40 and the pivot 27 that will allow the passage of the ASTM small probe 42 when the changing table is in the uppermost raised operative position.

Figure 6:
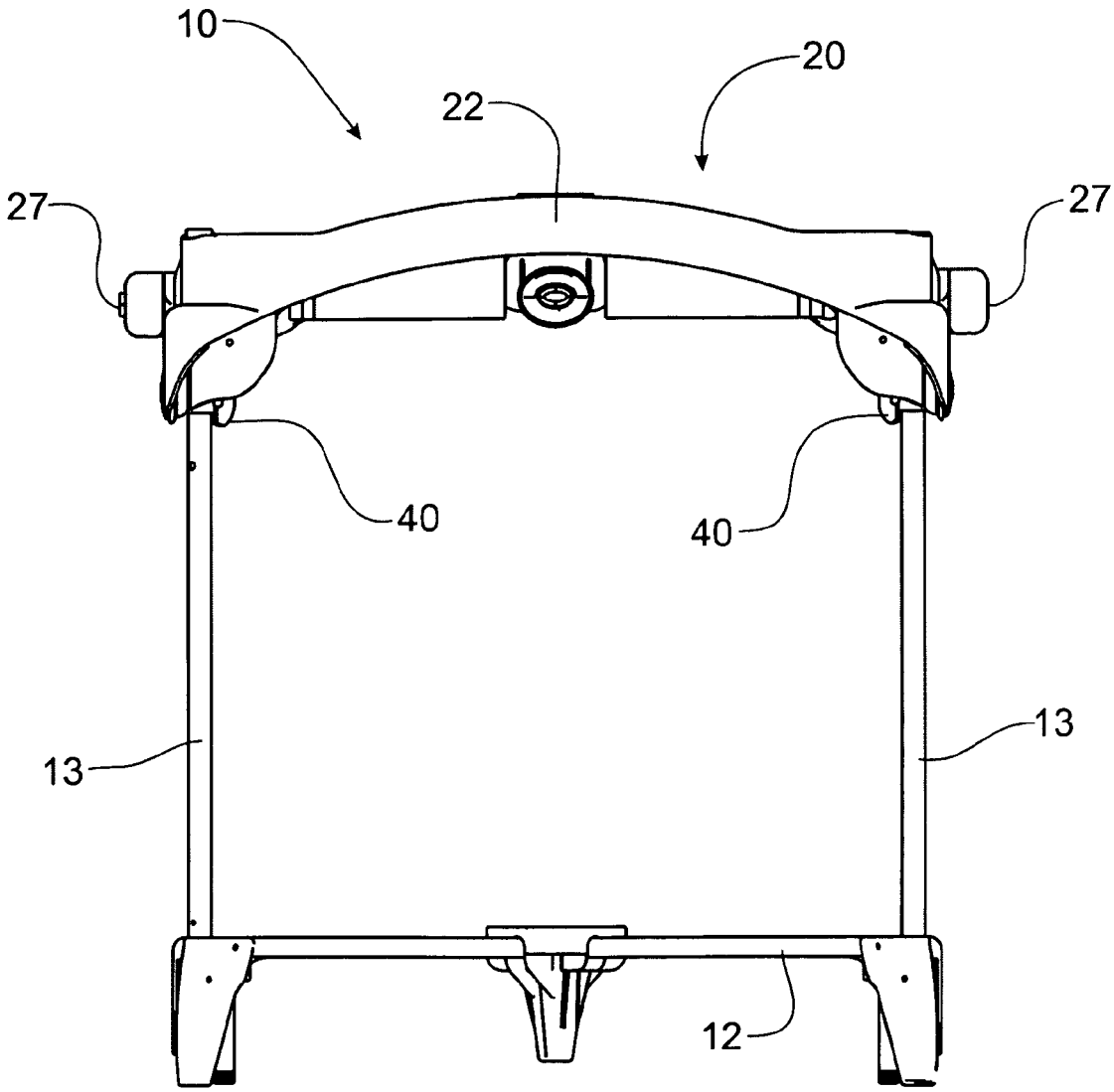
FIG. 6 is an end elevational view of the play yard and changing table frames as depicted in FIG. 4.
Figure 7:
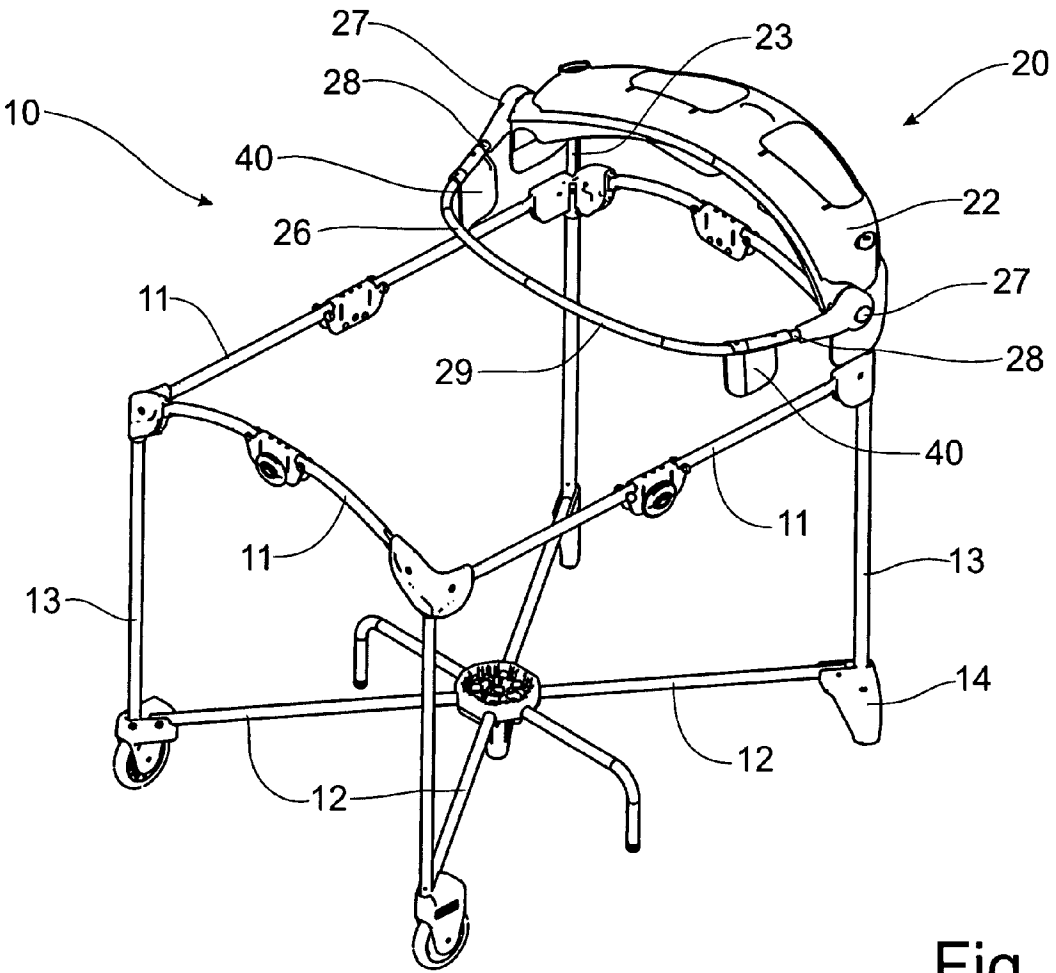
FIG. 7 is a perspective view of the play yard and changing table frames as depicted in FIG. 3 with the changing table frame in a raised operative position.
Figure 8:
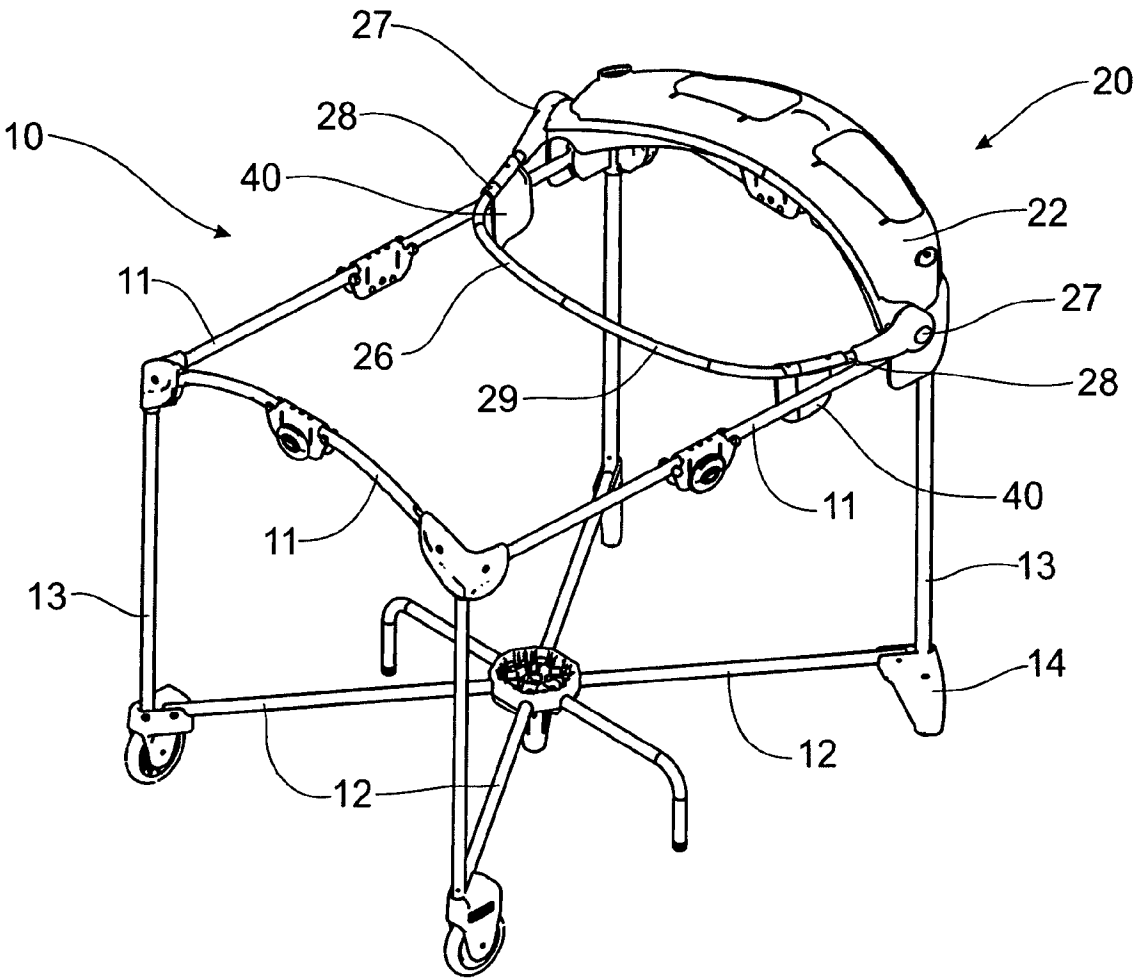
FIG. 8 is a perspective view of the play yard and changing table frames as depicted in FIG. 4 with the changing table frame in a lowered operative position.
Figure 9:
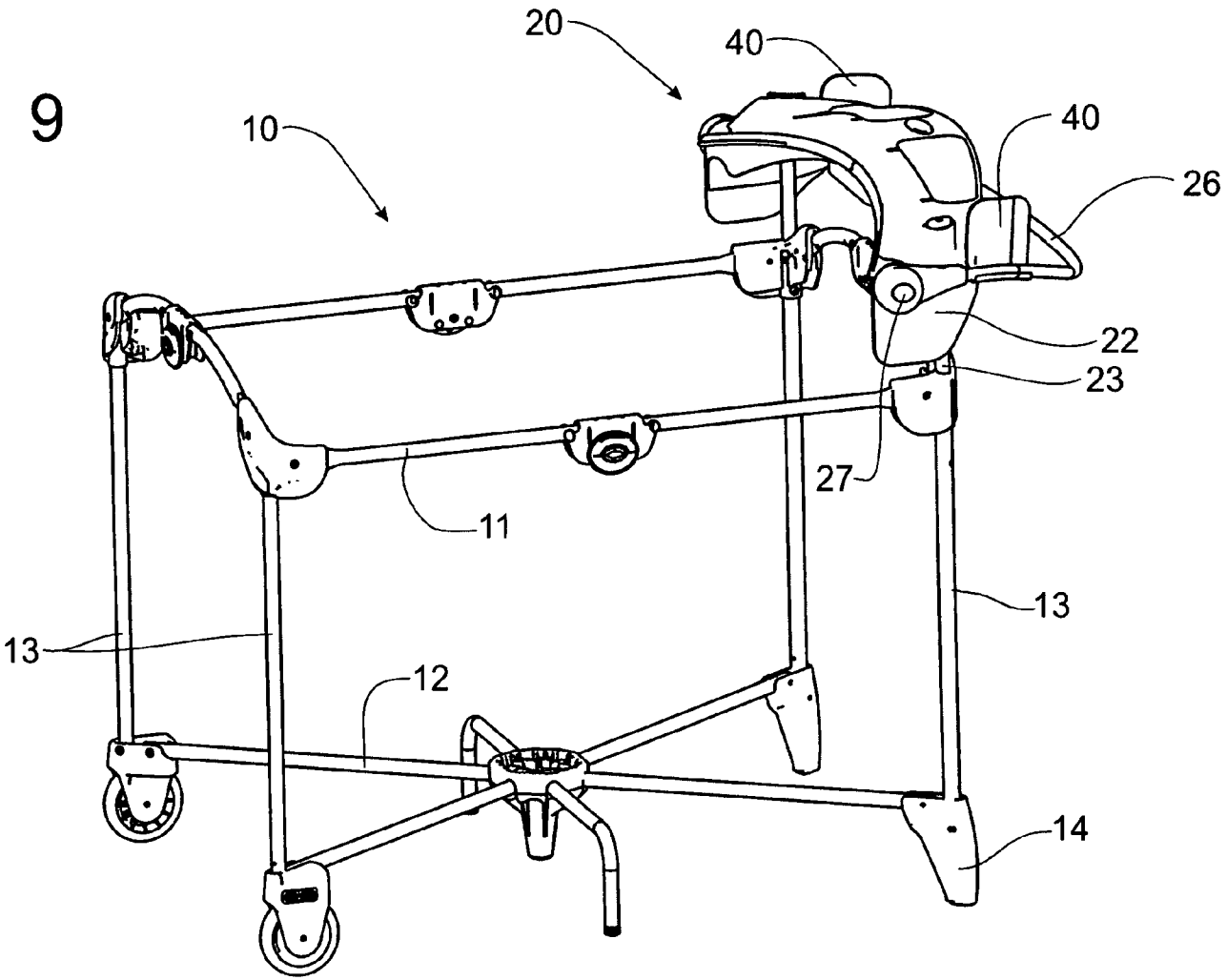
FIG. 9 is a perspective view of the play yard and changing table frames with the changing table frame pivoted into the inoperative position.
Figure 10:
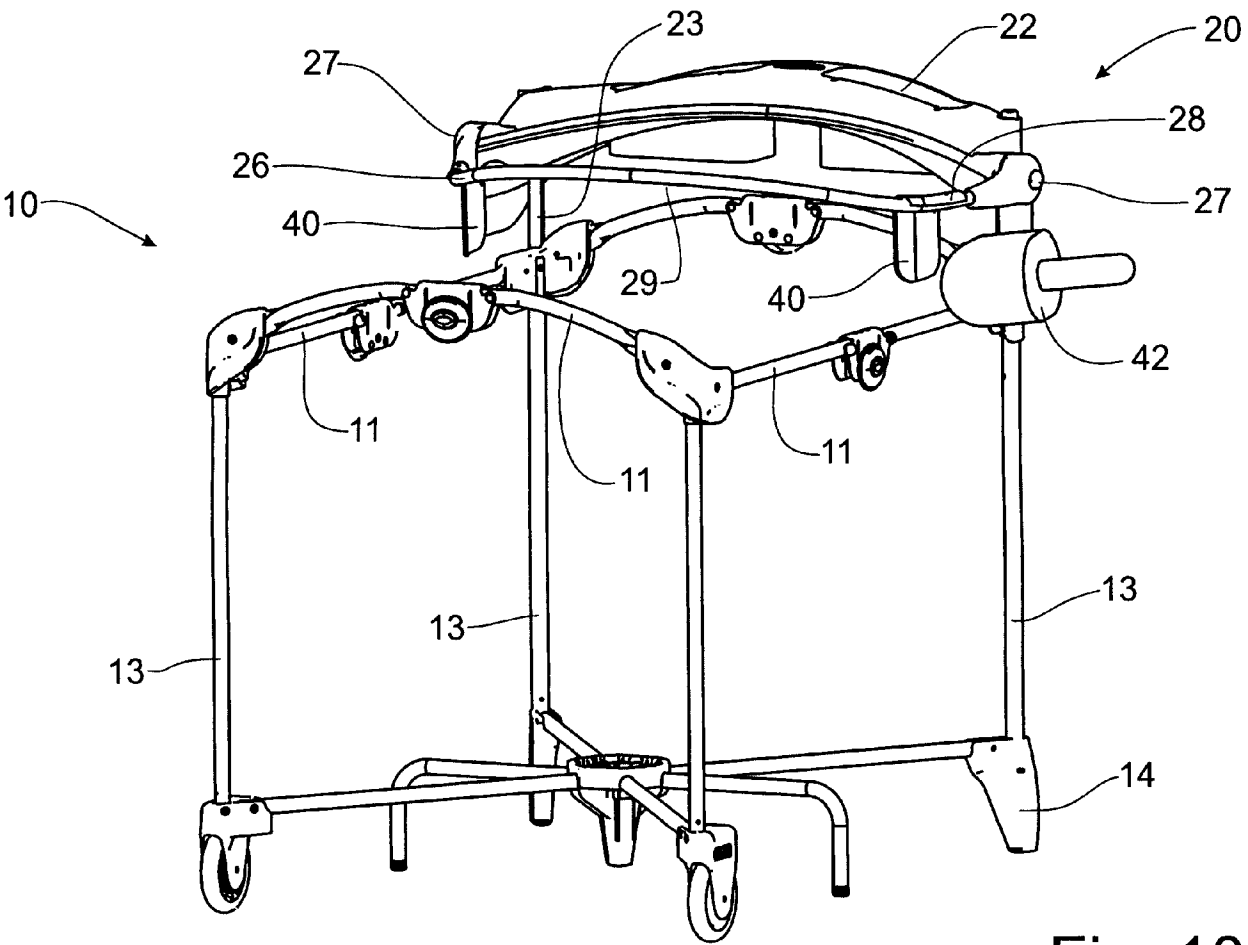
FIG. 10 is a perspective view of the play yard and changing table frames similar to that shown in FIG. 7 and depicting the placement of an ASTM probe at the opening between the changing table frame and the upper horizontal frame member of the play yard frame to reflect the operation of the guard member.

As the changing table 20 is lowered toward the lowermost operative position, which is depicted in FIGS. 4, 6 and 8, the guard member 40 lowers with the frame 26 and passes along the inside of the lower frame member 11 and ultimately extends below the upper frame member 11. One skilled in the art will recognize that the guard member 40 could also be configured to pass on the outside of the lower frame member. Thus, the guard member 40, which closes the gap between the frame 26 and the upper frame 11 when the changing table is at the uppermost raised position, becomes a non-entity when the changing table 20 is lowered toward the lowermost operative position. The table 25 can be pivoted into the inoperative position, shown in FIG. 9, from any operative position as the base member 22 is moved vertically with the table 25 when the changing table height is adjusted.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. A play yard comprising:

a frame structure defining an upper boundary member, a bottom member and sides extending between said upper boundary member and said bottom member;

a changing table having a table frame member and being mounted on said frame structure for vertical movement relative thereto between an uppermost operative position and a lowermost operative position; and a guard member mounted in a fixed position on one of said upper boundary member and said table frame member and having a vertical length terminating in a distal edge spaced from the member on which said guard member is mounted to permit said guard member to block a gap between said table frame member and said upper boundary member even when said changing table is in said uppermost operative position, said guard member being vertically movable with the member on which said guard member is mounted so as to be operable to block said gap such that the guard member can be positioned with said distal edge being positioned between the member to which the guard member is mounted and the member to which the guard member is not mounted at a distance less than a distance required to allow a child's head to be positioned between said upper boundary member and said table frame member even when said changing table is in said uppermost operative position.

2. The play yard of claim 1 wherein said changing table includes a base member, said table frame member being pivotally connected to said base member for movement relative thereto about a generally horizontal pivot axis between said operative positions and an inoperative position.

3. The play yard of claim 1 wherein said play yard includes post members, said base member includes mounting members vertically movable relative to said post members; and mounting members incorporating a locking apparatus to secure said mounting members at selected positions relative to said post members to position said table frame member at different heights relative to said upper boundary member.

4. The play yard of claim 3 wherein said locking apparatus includes a locking button spring-loaded into engagement with said post member to be extendable through an opening in said post member corresponding to the selected height position of said table frame member.

5. The play yard of claim 4 wherein said locking apparatus includes an actuator that is operable to retract said locking button from said post member to allow a repositioning of said table frame member.

6. The play yard of claim 2 wherein said table frame member includes a pair of transversely spaced longitudinally extending portions connected to a pivot defining said pivot axis and extending away from said base member, said table frame member further including a transverse portion interconnecting said longitudinally extending portions, said longitudinally extending portions being generally parallel to said upper boundary member.

7. The play yard of claim 6 wherein each said guard member is affixed to a corresponding longitudinally extending portion of said table frame member.

8. The play yard of claim 7 wherein each said guard member extends along the corresponding said longitudinally extending portion from said transverse portion toward the corresponding said pivot.

9. In a combination of a play yard and a changing table mounted on said play yard to provide an elevated support surface on which to place an infant, the play yard having a frame structure defining an upper boundary member and including post members, said changing table having a table frame member including generally longitudinally extending portions oriented generally parallel to said upper boundary member and being interconnected by a transversely extending portion, the improvement comprising:

a guard member associated with each said generally longitudinally extending portion and extending vertically so that each said guard member blocks a gap between said generally longitudinally extending portion of said table frame member and said upper boundary member, said table frame member being movable between a lowermost operative position in which said gap has a minimum height dimension and an uppermost operative position in which said gap has a maximum height dimension, said guard member having a vertical length terminating in a bottom edge and being sufficient to block said gap from said lowermost operative position to said uppermost operative position to prevent a child's head from being trapped between said table frame member and said upper boundary member throughout the movement of said table frame member, said bottom edge of said guard member being positioned at a spaced relationship to said upper boundary member when said table frame member is in said uppermost operative position with the distance between said upper boundary member and said bottom edge of said guard member being less than a distance necessary for a child's head to pass between said upper boundary member and said table frame member.

10. The combination of claim 9 wherein said changing table includes a base member, said table frame member being pivotally connected to said base member for movement relative thereto about a generally horizontal pivot axis between said operative positions and an inoperative position, said bottom edge of said guard member being located above said upper boundary member when said table frame member is in said upper operative position.

11. The combination of claim 9 wherein said play yard includes post members, said base member including mounting members vertically movable relative to said post members, each of said mounting members incorporating a locking apparatus to secure said mounting members at selected positions relative to said post members to position said table frame member at different heights relative to said upper boundary member.

12. The combination of claim 11 wherein said locking apparatus includes a locking button spring-loaded into engagement with said post member to be extendable through an opening in said post member corresponding to the selected height position of said table frame member, said locking apparatus further including a manually activated actuator that is operable to retract said locking button from said post member to allow a repositioning of said table frame member.

13. The combination of claim 11 wherein each said guard member extends along the corresponding said longitudinally extending portion from said transverse portion toward the corresponding said pivot.

14. A changing table mountable on a play yard to provide an elevated surface for supporting a child, said play yard having an upper boundary member and post members, comprising:

a base member;

a table frame member supporting an infant support surface and being pivotally connected to said base member for movement relative thereto about a generally horizontal pivot axis between an operative position and an inoperative position, said base member including mounting members vertically movable relative to said post members, each of said mounting members incorporating a locking apparatus to secure said mounting members at selected positions relative to said post members to position said table frame member at different heights relative to said upper boundary member, said locking apparatus including a locking button spring-loaded into engagement with the corresponding said post member to be extendable through an opening in said post member corresponding to the selected height position of said table frame member, said locking apparatus further including a manually activated actuator that is operable to retract said locking button from said post member to allow a repositioning of said table frame member; and a guard member associated with said table frame member and being oriented vertically so that said guard member blocks a gap between said table frame member and said upper boundary member when said changing table is in said operative position.

15. The changing table of claim 14 wherein said table frame member includes a pair of transversely spaced longitudinally extending portions connected to a pivot defining said pivot axis and extending away from said base member, said table frame member further including a transverse portion interconnecting said longitudinally extending portions, said longitudinally extending portions being generally parallel to said upper boundary member, said guard member being affixed to each said longitudinally extending portion of said table frame member.

16. The changing table of claim 15 wherein each said guard member extends along a corresponding said longitudinally extending portion from said transverse portion toward the corresponding said pivot.

17. The changing table of claim 14 wherein said base member is supported for generally vertical movement between an uppermost operative position and a lowermost operative position.

18. The changing table of claim 17 wherein said base member is formed with at least one mounting member movable relative to a corresponding said post member, each said mounting member including a locking apparatus to secure said mounting member at selected operative positions relative to said vertical frame members to position said table frame member at different heights relative to said upper boundary member.

* * * * *